US010067441B2

(12) United States Patent
Yoshii

(10) Patent No.: US 10,067,441 B2
(45) Date of Patent: Sep. 4, 2018

(54) DEVELOPER CASE INCLUDING HOLDER TO HOLD ROTATOR AND IMAGE FORMING APPARATUS INCLUDING THE SAME

(71) Applicant: KYOCERA Document Solutions Inc., Osaka (JP)

(72) Inventor: Tatsuhiko Yoshii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/553,477

(22) PCT Filed: Dec. 11, 2015

(86) PCT No.: PCT/JP2015/084807
§ 371 (c)(1),
(2) Date: Aug. 24, 2017

(87) PCT Pub. No.: WO2016/143211
PCT Pub. Date: Sep. 15, 2016

(65) Prior Publication Data

US 2018/0046110 A1 Feb. 15, 2018

(30) Foreign Application Priority Data

Mar. 6, 2015 (JP) ..... 2015-044474

(51) Int. Cl.
*G03G 15/08* (2006.01)

(52) U.S. Cl.
CPC ..... *G03G 15/0875* (2013.01); *G03G 15/08* (2013.01); *G03G 15/0881* (2013.01); *G03G 15/0889* (2013.01)

(58) Field of Classification Search
CPC ..... G03G 15/0875; G03G 15/0881; G03G 15/0889
See application file for complete search history.

(56) References Cited

U.S. PATENT DOCUMENTS 6,104,895 A * 8/2000 Yokomori ..... G03G 15/0898 399/106
2005/0220498 A1* 10/2005 Ito ..... G03G 21/105 399/262
2014/0334850 A1* 11/2014 Mitsuhashi ..... G03G 15/0889 399/263

FOREIGN PATENT DOCUMENTS

JP 2010-096827 A 4/2010

* cited by examiner

*Primary Examiner* — Joseph S Wong
(74) *Attorney, Agent, or Firm* — Studebaker & Brackett PC

(57) ABSTRACT

A developer case (10) according to the present invention includes a case main body (30), a rotator (55, 56), a coupling (57), and a holder (49, 70, 80, 90). The case main body (30) contains developer. The rotator (55, 56) is rotatably arranged between a pair of sidewalls (43F, 43B) of the case main body (30). The pair of sidewalls (43F, 43B) are opposed to each other. The coupling (57) is coupled to the rotator (55, 56) with at least one of the pair of sidewalls (43F, 43B) in between. The holder (49, 70, 80, 90) protrudes on an inner face of at least the one of the pair of sidewalls (43F, 43B) and holds an end in an axis direction of the rotator (55, 56) at a position where the end is capable of coupling to the coupling (57).

5 Claims, 11 Drawing Sheets

DEVELOPER CASE INCLUDING HOLDER TO HOLD ROTATOR AND IMAGE FORMING APPARATUS INCLUDING THE SAME

TECHNICAL FIELD

The present invention relates to a developer case suitably used for a copying machine and a printer, and an image forming apparatus which includes the developer case.

BACKGROUND ART

An image forming apparatus, such as a copying machine and a printer, develops a latent image on an image carrier by using developer (toner) to be supplied from a development device. The developer is contained in a developer case, and is supplied from the developer case to the development device.

A toner container disclosed in Patent Document 1 includes an agitator which agitates a toner stored in a container case. The container case includes a case main body of a box shape with an opened upper face, and a lid which seals the upper face of the case main body. A left plate of the case main body is provided with a U-shaped groove member, and a right plate is provided with an axial support hole bored therein. The agitator is arranged between the U-shaped groove member and the axial support hole, and is rotatably supported around an axis.

PRIOR ART DOCUMENT

Patent Document

[Patent Document 1] Japanese patent laid-open publication No. 2010-096827

SUMMARY OF INVENTION

Technical Problem

In the toner container disclosed in Patent Document 1, the agitator is assembled according to a following procedure. An operator puts the agitator in the case main body from an upper side (upper face opening), and engages a left end of the agitator with the U-shaped groove member. Next, the operator inserts a coupling from an outer side of the right plate into the axial support hole while keeping a state where a right end of the agitator is positioned with respect to the axial support hole. A distal end of the coupling fits to the right end of the agitator. According to this, the agitator is axially supported in the case main body with the coupling in between.

However, the operator needs to continue keeping a posture of the agitator in the case main body until the coupling is fitted to the agitator. Therefore, it is not possible to easily and quickly perform an assembly operation (assembling operation) of a rotator such as the agitator in the toner container disclosed in Patent Document 1.

To solve the above problem, the present invention provides a developer case which improves operability for assembling a rotator, and an image forming apparatus which includes the developer case.

Solution to Problem

A developer case according to the present invention includes a case main body, a rotator, a coupling, and a holder. The case main body contains developer. The rotator is rotatably arranged between a pair of sidewalls of the case main body. The pair of sidewalls are opposed to each other. The coupling is coupled to the rotator with at least one of the pair of sidewalls in between. The holder protrudes on an inner face of at least the one of the pair of sidewalls and holds an end in an axis direction of the rotator at a position where the end is capable of coupling to the coupling.

An image forming apparatus according to the present invention includes the above developer case.

Advantageous Effects of Invention

According to the present invention, it is possible to improve operability for assembling a rotator.

DESCRIPTION OF EMBODIMENTS

A preferred embodiment of the present invention will be described below with reference to the accompanying drawings. In this regard, the preferred embodiment will be described based on a direction shown in each drawing for ease of description. Further, an "upstream", a "downstream" and terms similar to the "upstream" and the "downstream" indicate the "upstream", the "downstream" and concepts of the "upstream" and the "downstream" in a conveying direction of a toner (developer).

Figure 1:
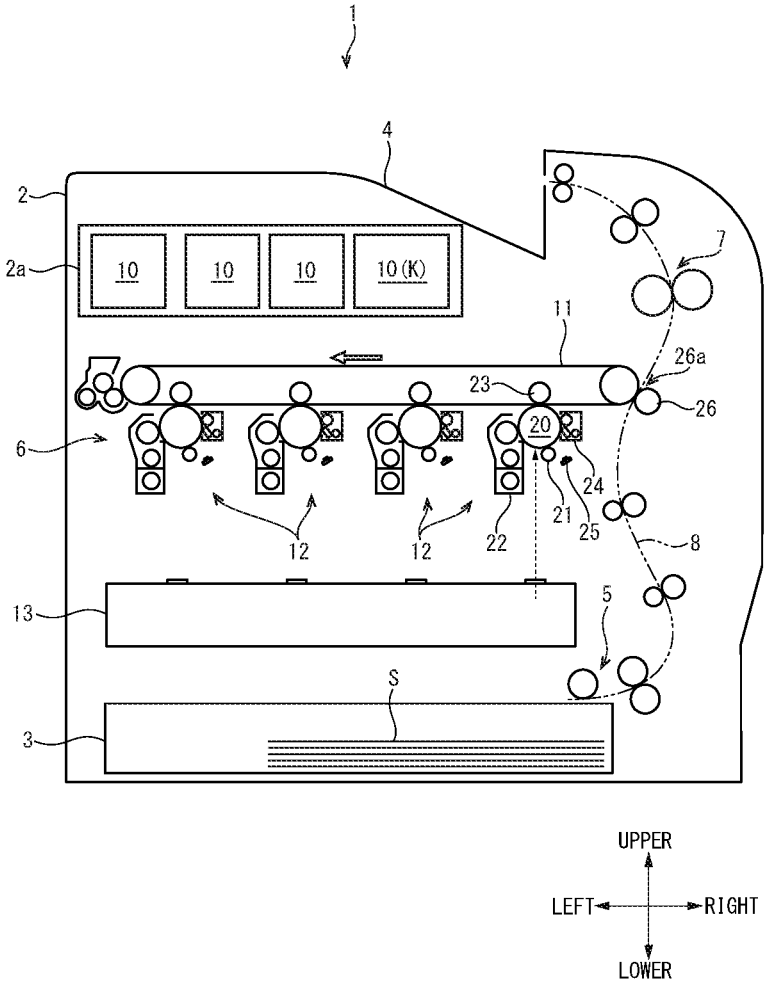
FIG. 1 is a front view schematically showing an inner structure of a color printer according to an embodiment of the present invention.

An entire configuration of a color printer 1 as an image forming apparatus will be described with reference to FIG. 1. FIG. 1 is a front view schematically showing an inner structure of the color printer 1.

The color printer 1 includes an apparatus main body 2, a sheet feeding cassette 3 and an ejection tray 4. The apparatus main body 2 is formed in a substantially rectangular box shape. The sheet feeding cassette 3 is provided at a lower part of the apparatus main body 2. The ejection tray 4 is provided at an upper part of the apparatus main body 2.

Further, the color printer 1 includes a conveying part 5, an image forming part 6 and a fixing device 7 inside the apparatus main body 2. The conveying part 5 feeds sheets S in the sheet feeding cassette 3 toward a conveying path 8 extended from the sheet feeding cassette 3 to the ejection tray 4. The image forming part 6 is provided at an intermediate part of the conveying path 8. The fixing device 7 is provided at a downstream side of the conveying path 8. In this regard, the sheets S are not limited to sheets made of paper, and include resin films and OHP (Over Head Projector) sheets.

The image forming part 6 includes four toner containers 10, an intermediate transfer belt 11, four drum units 12, and an optical scanning device 13. The four toner containers 10 are provided in a row in a left and right direction below the ejection tray 4. The intermediate transfer belt 11 is provided to be able to run in an outlined arrow direction below each toner container 10. The four drum units 12 are provided in a row in the left and right direction below the intermediate transfer belt 11. The optical scanning device 13 is disposed below each drum unit 12.

The four toner containers 10 contain four (yellow, magenta, cyanogen and black) toners (developers). In this regard, the toners may be one-component developer including a magnetic toner or may be two-component developer including a toner and a carrier.

The four drum units 12 are provided to correspond to the respective color toners. Each drum unit 12 is configured to include a photosensitive drum 20, a charging device 21, a development device 22, a primary transfer roller 23, a cleaning device 24 and a static eliminating device 25. In this regard, the four drum units 12 employ the same configuration, and therefore one drum unit 12 will be described below.

The photosensitive drum 20 is formed in a cylindrical shape which can rotate around an axis. The photosensitive drum 20 is in contact with a lower side face of the intermediate transfer belt 11. The charging device 21, the development device 22, the primary transfer roller 23, the cleaning device 24 and the static eliminating device 25 are disposed in a transfer process order around the photosensitive drum 20. The development device 22 is connected with the toner container 10 and receives replenishment of the toner from the toner container 10. The primary transfer roller 23 is disposed above the photosensitive drum 20 across the intermediate transfer belt 11. At a right side of the intermediate transfer belt 11, a secondary transfer roller 26 which forms a secondary transfer nip part 26*a* is disposed.

Hereinafter, an operation of the color printer 1 will be described. A controller (not shown) of the color printer 1 executes image forming processing as follows based on input image data.

Each charging device 21 charges a face of each photosensitive drum 20. The optical scanning device 13 performs exposure (see a broken line arrow in FIG. 1) corresponding to image data on each photosensitive drum 20. Each development device 22 develops an electrostatic latent image arranged on the face of each photosensitive drum 20 to a toner image. Each of four toner images carried by each photosensitive drum 20 is primarily transferred in order on the running intermediate transfer belt 11 by the primary transfer roller 23 to which a primary transfer bias has been applied. Thus, a full-color toner image is formed on the face of the intermediate transfer belt 11.

Meanwhile, the sheet S supplied from the sheet feeding cassette 3 is conveyed on the conveying path 8 and passes the secondary transfer nip part 26*a*. The full-color toner image is secondarily transferred on the sheet S by the secondary transfer roller 26 to which a secondary transfer bias has been applied. The fixing device 7 fixes the full-color toner image to the sheet S. The sheet S after the fixing processing is discharged to the ejection tray 4. Each cleaning device 24 removes the toner remaining on the face of each photosensitive drum 20 after the transfer. Each static eliminating device 25 radiates static eliminating light and eliminates charges of each photosensitive drum 20.

Figure 2:
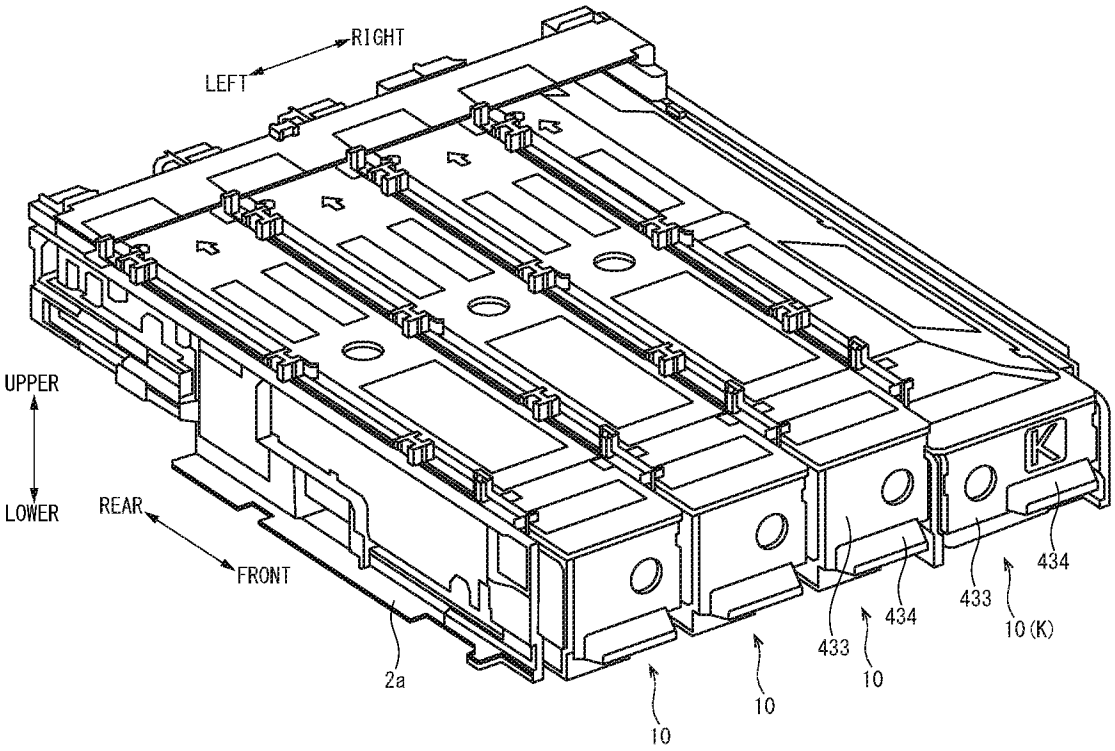
FIG. 2 is a perspective view showing toner containers and an attachment part according to the embodiment of the present invention.
Figure 3:
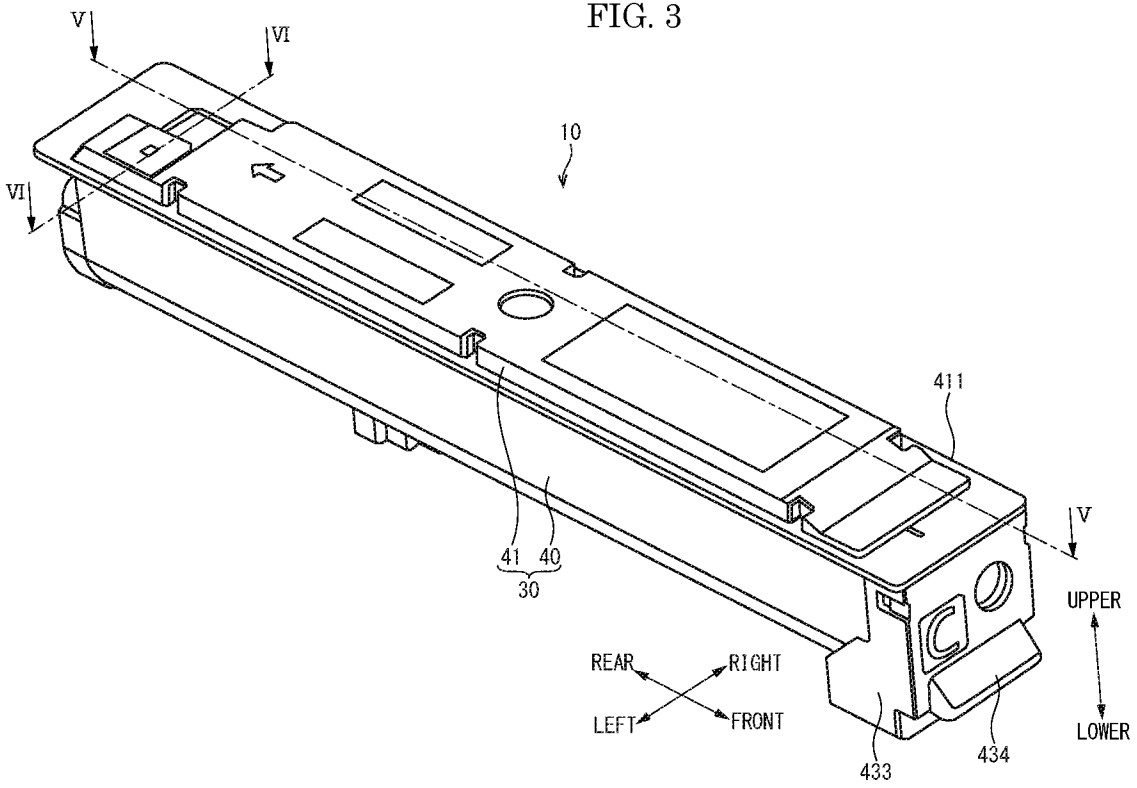
FIG. 3 is a perspective view showing the toner container according to the embodiment of the present invention.
Figure 4:
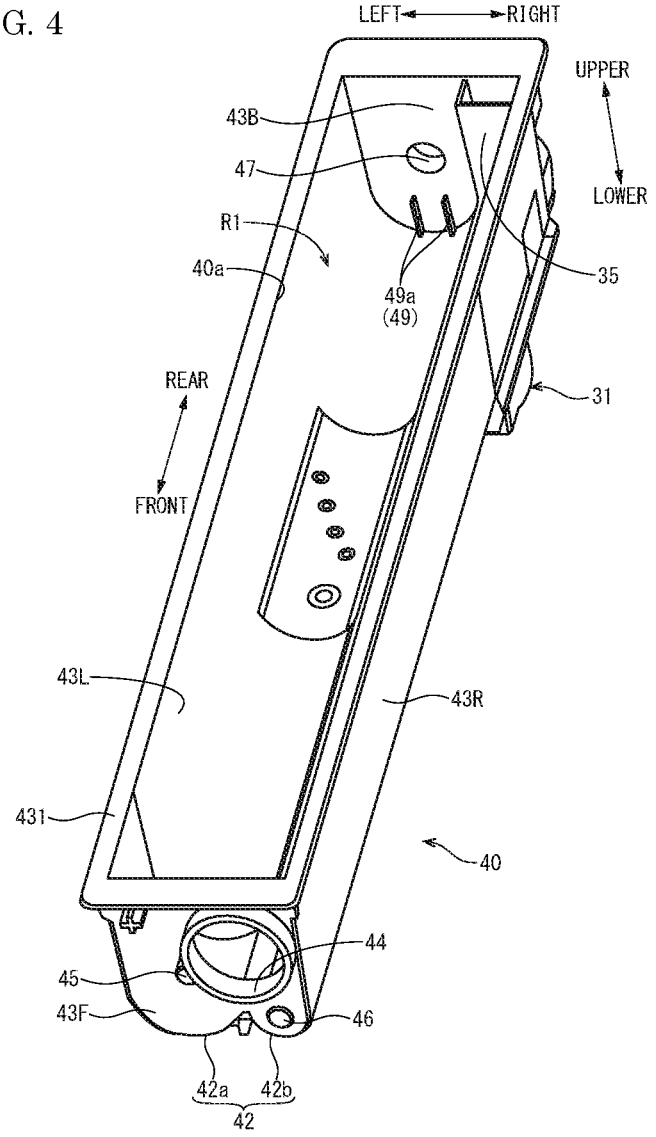
FIG. 4 is a perspective view showing a storing case of the toner container according to the embodiment of the present invention.
Figure 5:
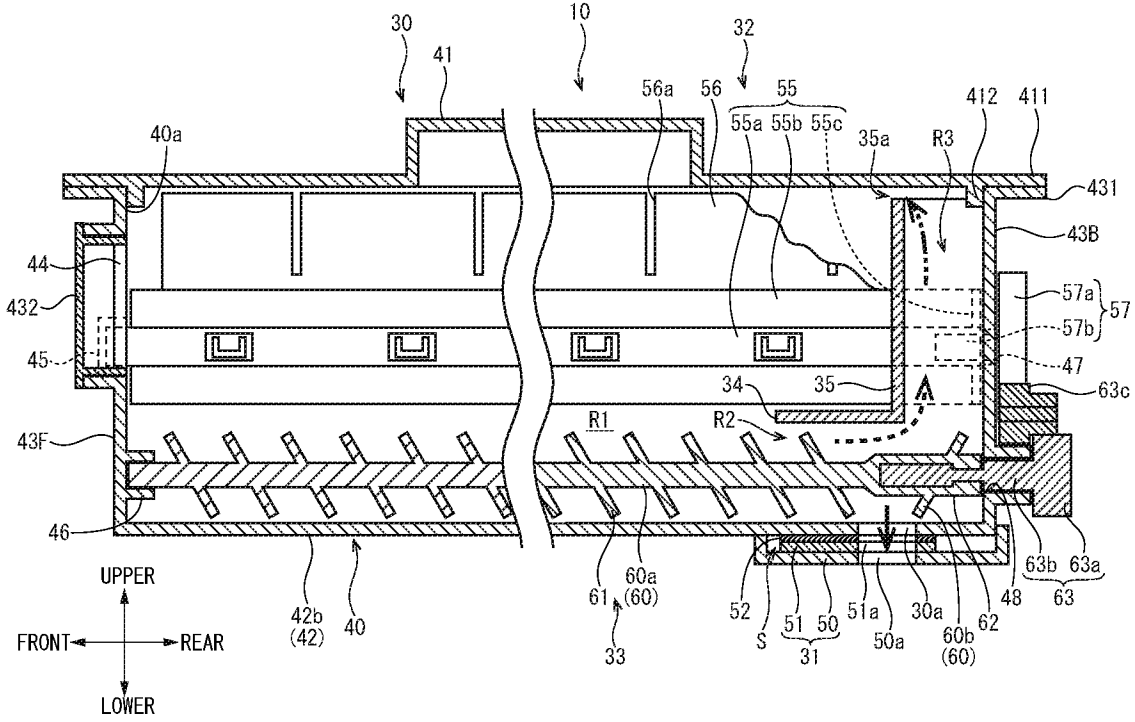
FIG. 5 is a sectional view taken along a V-V line in FIG. 3.
Figure 6:
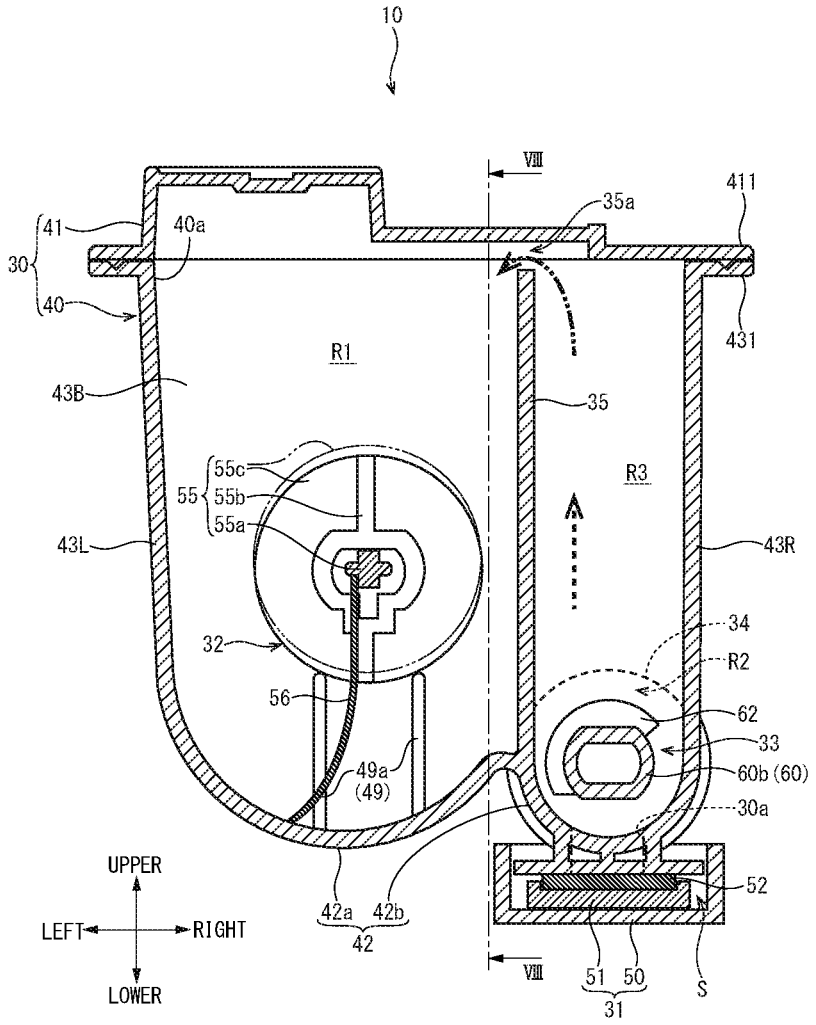
FIG. 6 is a sectional view taken along a VI-VI line in FIG. 3.
Figure 7:
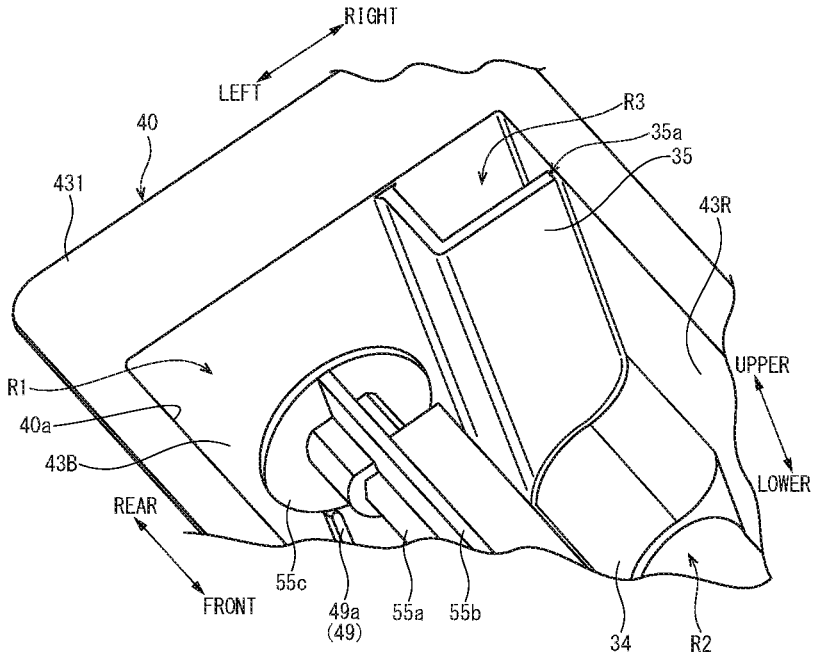
FIG. 7 is a perspective view showing a rear part of the storing case of the toner container according to the embodiment of the present invention.

Next, each toner container 10 as a developer case will be described with reference to FIGS. 1 to 7. FIG. 2 is a perspective view showing the toner containers 10 and an attachment part. FIG. 3 is a perspective view showing the toner container 10. FIG. 4 is a perspective view showing a storing case 40 of the toner container 10. FIG. 5 is a sectional view taken along a V-V line in FIG. 3. FIG. 6 is a sectional view taken along a VI-VI line in FIG. 3. FIG. 7 is a perspective view showing a rear part of the storing case 40 of the toner container 10.

As shown in FIGS. 1 and 2, at the upper part of the apparatus main body 2, an attachment part 2*a* in which the four toner containers 10 are aligned in the left and right direction and attached is provided. Each toner container 10 is supported by the attachment part 2*a* in a slidable state in a front and rear direction. An upper front face of the apparatus main body 2 is provided with an opening/closing cover (not shown) to open and close the attachment part 2*a*. A user executes an operation of attaching and detaching each toner container 10 to and from the attachment part 2*a* by opening the opening/closing cover.

In this regard, the toner containers 10 which contain the toners of the respective color (yellow, magenta and cyanogen) except black (k) among the four toner containers 10 have the same volume and are set to the same specification. By contrast with this, the toner container 10 (K) which contains the black toner is set to a larger volume than the other toner containers 10, and has a different specification, too. However, the four toner containers 10 differ in the volumes and the specific specifications and employ the same basic configuration, and therefore the toner container 10 which contains the toner of each color except black will be described.

As shown in FIGS. 3 and 5, the toner container 10 is configured to include a case main body 30, a shutter mechanism 31, an agitator 32, a conveyer 33, a first tube 34 and a second tube 35. The case main body 30 contains the toner (developer) and includes a discharge port 30*a* through which the toner is discharged to the development device 22. The shutter mechanism 31 is provided to open and close the discharge port 30*a* of the case main body 30. The agitator 32 agitates and conveys the toner in the case main body 30. The conveyer 33 conveys the toner in the case main body 30 toward the discharge port 30*a*. The first tube 34 and the second tube 35 are provided in the case main body 30.

As shown in FIG. 3, the case main body 30 is formed in a substantially cuboid shape which is long in the front and rear direction by using a synthetic resin material, for example. The case main body 30 includes the storing case 40 and a lid 41. The storing case 40 includes sidewalls 43F, 43B, 43L and 43R erected around a bottom 42, and is formed in a box shape with an opened upper face (see FIG. 4). The lid 41 is provided to seal the upper face of the storing case 40. Inside the case main body 30, a storing room R1 in which the toner is stored is arranged (see FIG. 4).

As shown in FIG. 4, the bottom 42 includes an agitating recess part 42*a* and a conveying recess part 42*b* which are curved so as to protrude downward when seen from a front view. The agitating recess part 42*a* continues to a left side of the conveying recess part 42*b* when seen from the front view, and is formed larger in the left and right direction than the conveying recess part 42*b*. In a rear lower surface of the conveying recess part 42*b*, the discharge port 30*a* is opened (see FIGS. 5 and 6). The discharge port 30*a* is arranged so as to penetrate the conveying recess part 42*b* in an upper and lower direction.

Upper ends of the sidewalls 43F, 43B, 43L and 43R compose an upper face opening 40*a* which is formed in a rectangular shape when seen from a plan view. At the upper ends of the sidewalls 43F, 43B, 43L and 43R, a case side flange 43R extending outward when seen from a plan view is arranged. In the front sidewall 43F, a loading port 44 through which the toner is loaded in the case main body 30 (storing room R1) is opened. The loading port 44 is sealed by a cap 432 (see FIG. 5). A cover 433 which covers the loading port 44 is attached to the front sidewall 43F (see FIG. 3). A grip part 434 which the user grips to attach or detach the toner container 10 is arranged on the cover 433 (see FIG. 2). In this regard, on a face of the cover 433, a letter (symbol) indicating the toner color is embossed.

As shown in FIG. 5, an agitating bearing boss 45 and a conveying bearing boss 46 are arranged in the front sidewall 43F. The agitating bearing boss 45 is arranged so as to protrude in a cylindrical shape on an outer face (front face) of the sidewall 43F. The agitating bearing boss 45 is arranged near a curvature center of the agitating recess part 42*a* when seen from the front view (see FIG. 4). The conveying bearing boss 46 is arranged so as to protrude in a cylindrical shape on an inner face (rear face) of the sidewall 43F. The conveying bearing boss 46 is arranged near a curvature center of the conveying recess part 42*b* when seen from the front view (see FIG. 4). In the rear sidewall 43B, an agitating support hole 47 and a conveying support hole 48 are arranged. The agitating support hole 47 is arranged near the curvature center of the agitating recess part 42*a* when seen from the front view (see FIG. 4). The conveying support hole 48 is arranged near the curvature center of the conveying recess part 42*b* when seen from the front view.

As shown in FIGS. 4 and 6, on an inner face of the rear sidewall 43B, a holder 49 protrudes. The holder 49 includes a pair of left and right ribs 49*a* extending in the upper and lower direction. The pair of left and right ribs 49*a* are arranged so as to be separated from each other in the left and right direction (width direction). Each rib 49*a* extends from an upper face of the agitating recess part 42*a* toward an upper side in the vertical direction along the sidewall 43B. An upper end of each rib 49*a* is positioned below a lower side rim of the agitating support hole 47. Further, the upper end of each rib 49*a* is formed in a substantially arc shape.

By the way, the storing case 40 and the holder 49 are integrally formed by an injection molding technique by using a metallic mold (not illustrated). The storing case 40 with an opened upper face is molded by using a metallic mold which can be vertically divided (released). Hence, the pair of ribs 49*a* extend along a releasing direction (in substantially parallel) in which the metallic mold is released upward. In this regard, the storing case 40 and the holder 49 may be molded not by injection molding but by a resin processing technique, such as press working, blow molding or vacuum molding.

As shown in FIG. 3, the lid 41 is formed in the substantially same shape as that of the storing case 40 when seen from the plan view. At an entire periphery of a lower part of the lid 41, a lid side flange 411 is arranged. The lid 41 is disposed such that the lid side flange 411 faces the case side flange 431. Both of the flanges 411 and 431 are bonded by an adhesive (or welding processing) to fix the lid 41 to the storing case 40 (see FIGS. 5 and 6). According to this, the upper face opening 40*a* of the storing case 40 is sealed by the lid 41.

As shown in FIGS. 5 and 6, the shutter mechanism 31 includes a holding member 50 and a shutter 51.

The holding member 50 is formed in a substantially box shape which is flat in the upper and lower direction with an opened upper face. The holding member 50 is attached to a lower face of the conveying recess part 42*b* so as to cover the surroundings of the discharge port 30*a*. Between a bottom face of the holding member 50 and the lower face of the conveying recess part 42*b*, an installation space S in which the shutter 51 and the like are disposed is arranged. A first communication hole 50*a* is arranged at a position of the holding member 50 meeting the discharge port 30*a* when seen from a bottom view. The first communication hole 50*a* is arranged so as to penetrate the holding member 50 in the upper and lower direction.

The shutter 51 is formed in a substantially rectangular shape when seen from the plan view, and is held in the installation space S. On an upper face of the shutter 51, a seal 52 formed by using a synthetic rubber is fixed. At a part (rear side) of the shutter 51 (seal 52), a second communication hole 51*a* which penetrates in the upper and lower direction is arranged. The shutter 51 is slidable between an opening position at which the second communication hole 51*a* matches with the discharge port 30*a* (see FIG. 5), and a closed position at which the second communication hole 51*a* is displaced from the discharge port 30*a*.

In a state where the toner container 10 is detached from the attachment part 2*a*, the shutter 51 is biased by a biasing member (not shown) and is kept in the closed position. At this time, the seal 52 comes into close contact with the periphery part of the discharge port 30*a*. Consequently, it is possible to prevent leakage of the toner from the discharge port 30*a*. Meanwhile, in a process of attaching the toner container 10 to the attachment part 2*a*, the shutter 51 engages with an engagement part (not shown) provided to the attachment part 2*a*, and moves from the closed position to the opening position (see FIG. 5). Thus, the discharge port 30*a* connects to a toner conveying path (not shown) which extends from the development device 22 via each of the communication holes 50*a* and 51*a*. Further, the toner discharged from the discharge port 30*a* is replenished to the development device 22 through the toner conveying path.

As shown in FIGS. 5 and 6, the agitator 32 is disposed on the agitating recess part 42*a*. The agitator 32 includes an agitating rotation shaft 55, an agitating blade 56 and an agitating coupling 57. The agitating rotation shaft 55 is rotatably supported around an axis in the case main body 30. The agitating blade 56 is fixed along a longitudinal direction of the agitating rotation shaft 55. The agitating coupling 57 (coupling) is provided on a coaxial center of the agitating rotation shaft 55. In this regard, "rotator" in the claims is a concept which includes the agitating rotation shaft 55 or both of the agitating rotation shaft 55 and the agitating blade 56.

The agitating rotation shaft 55 is formed in a stick shape which is long in the front and rear direction by using a synthetic resin material, for example. The agitating rotation shaft 55 is arranged between a pair of sidewalls 43F and 43B which are opposed to each other in the front and rear direction. The agitating rotation shaft 55 includes a corner axis 55*a*, a pair of axial plates 55*b* and a flange 55*c* which are integrally formed.

The corner axis 55*a* is formed in a substantially rectangular shape when seen from the front view (cross sectional view). A front end of the corner axis 55*a* is rotatably supported by the agitating bearing boss 45 with a boss axis (not shown) in between. A rear end of the corner axis 55*a* is formed in a hollow shape. The rear end of the corner axis 55*a* is rotatably supported in the agitating support hole 47 with the agitating coupling 57 in between. The pair of axial plates 55*b* extend from a pair of opposed faces of the corner axis 55*a* to an outside in a radial direction. Each axial plate 55*b* is formed along a longitudinal direction of the corner axis 55*a*. The flange 55*c* is formed at the rear end of the corner axis 55*a* so as to widen in the radial direction (see FIG. 7). The flange 55*c* is formed in a disk shape which is coaxial with the corner axis 55*a* when seen from the front view.

The agitating blade 56 is formed in a rectangular shape which is long in the front and rear direction by using a synthetic resin film having flexibility. The agitating blade 56 is formed to have the substantially same length as that of the agitating rotation shaft 55. One side in the longitudinal direction of the agitating blade 56 is fixed to the corner axis 55*a* (one axial plate 55*b*). A width dimension of the agitating blade 56 (a dimension in a radial direction of the agitating rotation shaft 55) is set to be longer than a distance which connects an axial center of the agitating rotation shaft 55 and an inner face of the agitating recess part 42*a* (see FIG. 6). Further, on the agitating blade 56, a plurality of cut grooves 56*a* are arranged (see FIG. 5). Each cut groove 56*a* is cut from a free end side of the agitating blade 56 to a fixing side of the agitating rotation shaft 55.

As shown in FIG. 5, the agitating coupling 57 includes an agitating gear 57*a* and an agitating coupling shaft 57*b*. The agitating gear 57*a* is a so-called spur gear, and is disposed along a rear surface of the sidewall 43B. Although described in detail below, the agitating gear 57*a* is driven to rotate by a drive motor (not shown) provided in the apparatus main body 2. The agitating coupling shaft 57*b* is provided so as to protrude from a rotation axial center of the agitating gear 57*a*. The agitating coupling shaft 57*b* is inserted in the agitating support hole 47 of the sidewall 43B from a rear side, and is rotatably supported by the agitating support hole 47. A distal end (front end) of the agitating coupling shaft 57*b* is unrotatably coupled to a hollow inner part of the rear end of the corner axis 55*a* (flange 55*c*). According to this, the agitating coupling 57 is coupled to the agitating rotation shaft 55 with the sidewall 43B in between. In this regard, between an outer circumferential face of the agitating coupling shaft 57*b* and an inner circumferential face of the agitating support hole 47, an annular seal (not shown) for preventing the toner from leaking is arranged.

As shown in FIGS. 5 and 6, the conveyer 33 is disposed on the conveying recess part 42*b*. The conveyer 33 includes a conveying rotation shaft 60, a first blade 61, a second blade 62 and a conveying coupling 63. The conveying rotation shaft 60 is supported by the case main body 30 rotatably around the axis in the case main body 30. The first blade 61 and the second blade 62 are formed in spiral shapes, and are provided on a circumferential face of the conveying rotation shaft 60. The second blade 62 is provided in a reverse direction to a direction of the first blade 61. The conveying coupling 63 is provided on the same axial center as that of the conveying rotation shaft 60.

The conveying rotation shaft 60 is formed in a round bar shape which is long in the front and rear direction by using a synthetic resin material, for example. The conveying rotation shaft 60 is bridged between the pair of front and rear sidewalls 43F and 43B. The conveying rotation shaft 60 includes a rotation shaft part 60*a* and a fitting shaft part 60*b* which are formed integrally.

The rotation shaft part 60*a* extends from the front end to a proximity of the discharge port 30*a*. A front end of the rotation shaft part 60*a* is rotatably supported in the conveying bearing boss 46. The fitting shaft part 60*b* continues to a rear end of the rotation shaft part 60*a*. The fitting shaft part 60*b* has the same axial center as that of the rotation shaft part 60*a*, and is formed in a hollow cylindrical shape which is thicker than the rotation shaft part 60*a*. The fitting shaft part 60*b* is rotatably supported in the conveying support hole 48 via the conveying coupling 63. In this regard, a connection part of the rotation shaft part 60*a* and the fitting shaft part 60*b* is positioned above (a front side of) the discharge port 30*a* (see FIG. 5).

The first blade 61 is formed integrally with the rotation shaft part 60*a* by using a synthetic resin material, for example. The first blade 61 protrudes in the radial direction from a circumferential face of the rotation shaft part 60*a*, and is formed in a spiral shape along the longitudinal direction of the rotation shaft part 60*a*. In more detail, the first blade 61 is fixed between a front end of the conveying rotation shaft 60 and the discharge port 30*a* (see FIG. 5).

The second blade 62 is formed integrally with the fitting shaft part 60*b* by using a synthetic resin material, for example. The second blade 62 protrudes in the radial direction from a circumferential face of the fitting shaft part 60*b*, and is formed in a spiral shape of one or two turns. The second blade 62 is arranged such that its spiral direction is a reverse direction (reverse phase) to that of the first blade 61. The second blade 62 is formed to have the same diameter as that of the first blade 61 when seen from the front view. The second blade 62 is arranged at a downstream side (rear side) of the discharge port 30*a* (see FIG. 5). In this regard, the fitting shaft part 60*b* has a larger diameter than that of the rotation shaft part 60*a*, so that the conveying force of the first blade 61 gets larger than the conveying force of the second blade 62. In this regard, above the discharge port 30*a*, the first blade 61 and the second blade 62 are not provided (see FIG. 5).

As shown in FIG. 5, the conveying coupling 63 includes a conveying gear 63*a* and a conveying coupling shaft 63*b*. The conveying gear 63*a* is a so-called spur gear, and is disposed along a rear face of the sidewall 43B. The conveying gear 63*a* is coupled to a drive mechanism (not shown) including a drive gear and a gear train provided in the apparatus main body 2. The conveying gear 63*a* connects (meshes) with the agitating gear 57*a* via an intermediate gear 63*c*. The conveying coupling shaft 63*b* is provided so as to protrude from a rotation axial center of the conveying gear 63*a*. The conveying coupling shaft 63*b* is inserted in the conveying support hole 48 of the sidewall 43B from the rear side, and is rotatably supported in the conveying support hole 48. A distal end (front end) of the conveying coupling shaft 63*b* unrotatably fits to a hollow inner part of the fitting shaft part 60*b* of the conveying rotation shaft 60. In this regard, between an outer circumferential face of the conveying coupling shaft 63*b* and an inner circumferential face of the conveying support hole 48, an annular seal (not shown) for preventing the toner from leaking is arranged.

When the toner is consumed by executing the image forming processing, a controller of the color printer 1 executes an operation of replenishing the toner as follows, by controlling the driving of a drive motor. Drive force of the drive motor rotates the conveying gear 63*a* (conveying coupling shaft 63*b*). The rotation of the conveying gear 63*a* rotates the agitating gear 57*a* (agitating coupling shaft 57*b*) via the intermediate gear 63*c*. Thus, the agitating coupling 57 and the agitating rotation shaft 55 integrally rotate around the same axial center. Then, the agitating blade 56 agitates the toner in the storing room R1 while the agitating blade 56 is elastically curves and scrapes the toner attached to an inner face of the agitating recess part 42*a* (see FIG. 6). Similarly, the conveying coupling 63 and the conveying rotation shaft 60 integrally rotate around the same axial center. Then, the first blade 61 conveys the toner agitated by the agitator 32 to the discharge port 30*a*. When conveyed to the discharge port 30*a*, the toner is blocked by the rotation of the second blade 62. By this means, the toner is collected to the discharge port 30*a*, and is smoothly discharged from the discharge port 30*a* to an outside (development device 22) of the case main body 30 (see a bold line arrow in FIG. 5).

As shown in FIGS. 5 to 7, the first tube 34 is made of a synthetic resin, for example, and is arranged at a position covering the discharge port 30*a*. The first tube 34 is formed in a substantially cylindrical shape which extends in the front and rear direction together with a rear end of the conveying recess part 42*b*. Inside the first tube 34, a conveying room R2 which rotatably includes a rear end of the conveyer 33 is arranged. The inner diameter of the first tube 34 is formed slightly larger than the outer diameter of the first blade 61 of the conveyer 33.

The toner in the storing room R1 is fed into conveying room R2 by the rotating conveyer 33, and is discharged from the discharge port 30*a* to the development device 22 (see FIG. 5). The discharge port 30*a* is covered by the first tube 34, and therefore an excessive amount of the toner is not carried to the discharge port 30*a*. The first tube 34 adjusts the toner amount (replenishment amount) discharged from the discharge port 30*a*, so that it is possible to prevent the toner from being excessively replenished to the development device 22.

As shown in FIGS. 5 to 7, the second tube 35 is formed integrally with the storing case 40 by using a synthetic resin material, for example. The second tube 35 is formed in a rectangular shape which extends from an upper circumferential face of the first tube 34 to an upper side in a vertical direction along each of the sidewalls 43B and 43R. The second tube 35 communicates with the conveying room R2 at a position at which the second tube 35 overlaps with a rear side of the discharge port 30*a* when seen from a side view (see FIG. 5). Inside the second tube 35, an evacuation room R3 which communicates with the conveying room R2 is arranged. Between an upper end (front side and a left side) of the second tube 35 and a lower face of the lid 41, a gap 35*a* is formed. The gap 35*a* communicates the evacuation room R3 and the storing room R1. In this regard, a positioning protrusion 412 which is provided so as to protrude from the lower face of the lid 41 engages with a side of the sidewall 43B of the evacuation room R3 (see FIG. 5).

By the way, the toner is jammed in the discharge port 30*a* (toner discharge failure) in some cases. In these cases, when the conveyer 33 and the like continue rotating, the toner to be conveyed is introduced from the conveying room R2 to the evacuation room R3 (see broken line bold arrows in FIGS. 5 and 6). Thus, by evacuating the toner from the conveying room R2 to the evacuation room R3, it is possible to reduce a load acting on the conveyer 33 and a drive motor when the toner continues to be conveyed in a state where the toner discharge failure occurs. According to this, it is possible to prevent the conveyer 33 and the drive motor from being damaged.

Further, when the toner fills the inside of the evacuation room R3, the toner is discharged from the gap 35*a* at the upper part to the storing room R1 (see two-dot chain lines in FIGS. 5 and 6). Hence, the toner filling the inside of the evacuation room R3 does not apply an excessive load to the conveyer 33 and the drive motor. According to this, it is possible to protect the conveyer 33 and the drive motor.

Figure 8:
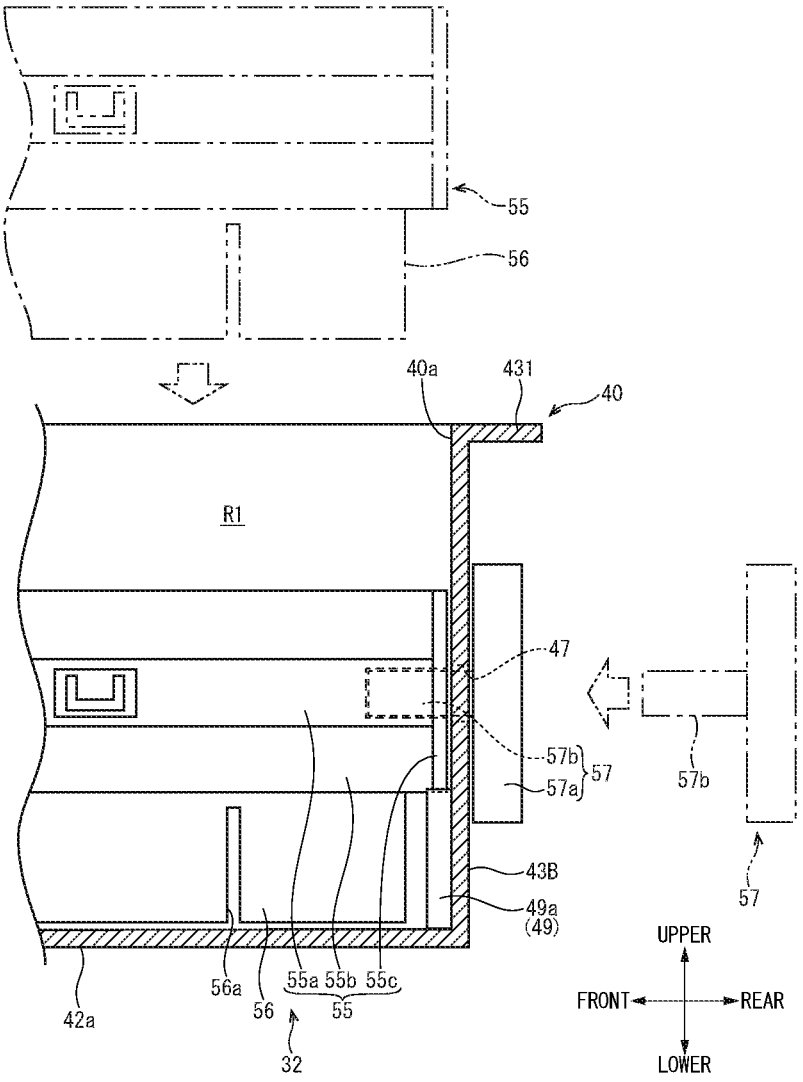
FIG. 8 is a sectional view taken along a VIII-VIII line in FIG. 6.

Next, a procedure of assembling the toner container 10 will be described with main reference to FIG. 8. FIG. 8 is a sectional view taken along a VIII-VIII line in FIG. 6.

The operator attaches the agitator 32 and the conveyer 33 to an inside of the storing case 40. First, the operator inserts the conveying rotation shaft 60 with each of the first blades 61 and 62 (referred to as the "conveying rotation shaft 60 and the like" below) in the inside from the upper face opening 40*a* of the storing case 40. The operator places the conveying rotation shaft 60 and the like on the conveying recess part 42*b* while fitting the front end of the conveying rotation shaft 60 (rotation shaft part 60*a*) to the conveying bearing boss 46 (see FIG. 5). Subsequently, the operator inserts the conveying coupling shaft 63*b* of the conveying coupling 63 from a rear side to the conveying support hole 48, and fits the conveying coupling shaft 63*b* to a rear end of the conveying rotation shaft 60 (fitting shaft part 60*b*) (see FIG. 5). According to this, the conveyer 33 is rotatably attached to the storing case 40.

Next, as shown in FIG. 8, the operator inserts the agitating rotation shaft 55 with the agitating blade 56 (referred to as the "agitating rotation shaft 55 and the like" below) in the inside from the upper face opening 40*a* of the storing case 40 (see a two-dot chain line in FIG. 8). The operator places the flange 55*c* on the pair of left and right ribs 49*a* (see a solid line in FIG. 8) while fitting a front end of the agitating rotation shaft 55 (corner axis 55*a*) to the agitating bearing boss 45 (see FIG. 5). The flange 55C fits between the pair of left and right ribs 49*a*, and is held at a stable posture by the upper ends of the pair of left and right ribs 49*a* (see a solid line in FIG. 6). In this state, a rear end face of the corner axis 55*a* opposes to the agitating support hole 47. That is, the holder 49 (each rib 49*a*) holds the flange 55*c* of the agitating rotation shaft 55 at a position where the flange 55*c* is capable of coupling to the agitating coupling 57 (agitating coupling shaft 57*b*).

Subsequently, the operator inserts the agitating coupling shaft 57*b* of the agitating coupling 57 from the rear side to the agitating support hole 47 (see the two-dot chain line in FIG. 8), and fits the agitating coupling shaft 57*b* to the rear end of the agitating rotation shaft 55 (corner axis 55*a*) (see the solid line in FIG. 8). In this case, an axis center of the corner axis 55*a* and a center of the agitating support hole 47 substantially match, so that the operator can easily fit the agitating coupling shaft 57*b* to a hollow part of the corner axis 55*a*. According to this, the agitator 32 is rotatably attached to the storing case 40 (see FIG. 5). In this regard, when the agitating coupling 57 is coupled to the agitating rotation shaft 55, the flange 55*c* is slightly separated upward from an upper end face of each rib 49*a* (see a two-dot chain line in FIG. 6). According to this, the flange 55*c* does not slide on each rib 49*a*, so that the agitator 32 can smoothly rotate. When each rib 49*a* and the flange 55*c* are formed by using a material of the good sliding property, the flange 55*c* may be in contact with the upper part of each rib 49*a* at all times.

Next, the case main body 30 is made by sealing the upper face opening 40*a* of the storing case 40 by the lid 41 (see FIG. 6). The toner is loaded from the loading port 44 to the storing room R1, and the loading port 44 is sealed by the cap 432 (see FIG. 5). Further, when the cover 433 is attached, assembly of the toner container 10 is finished (see FIG. 3).

As to the toner container 10 according to the present embodiment described above, only the holder 49 holds the rear ends of the agitating rotation shaft 55 and the like, so that the agitating rotation shaft 55 and the like are positioned at positions where the agitating rotation shaft 55 and the like are capable of coupling to the agitating coupling 57. According to this, the operator can easily and quickly perform an operation of coupling the agitating rotation shaft 55 and the like with the agitating coupling 57. That is, it is possible to improve operability of attaching the agitator 32 to the case main body.

Further, as to the toner container 10 according to the present embodiment, the holder 49 (each rib 49*a*) is integrally formed with the storing case 40 and, consequently, functions as a reinforcing member of the storing case 40. According to this, it is possible to improve the strength of the storing case 40. Further, to reliably perform mold release, each rib 49*a* is formed in a simple shape extending in the releasing direction (upper and lower direction) of the metallic mold. According to this, it is possible to simplify the shape of the metallic mold, and reduce manufacturing cost of the storing case 40 and the holder 49 (each rib 49*a*). Further, the pair of left and right ribs 49*a* are arranged in a row in the width direction, so that the holder 49 can stably hold the agitating rotation shaft 55 and the like via the flange 55*c*.

Furthermore, the agitating rotation shaft 55 and the agitating blade 56 as rotators are included in the agitator 32 which agitates the developer contained in the case main body 30. Consequently, the operator can easily and quickly perform the operation of assembling the agitator 32. That is, it is possible to improve assembly operability of the toner container 10.

Further, the agitating rotation shaft 55 includes the flange 55*c* which widens in the radial direction at an end part in an axis direction, and the holder 49 holds the flange 55*c*. Consequently, the holder 49 can stably hold the agitating rotation shaft 55 via the flange 55*c*.

Figure 9:
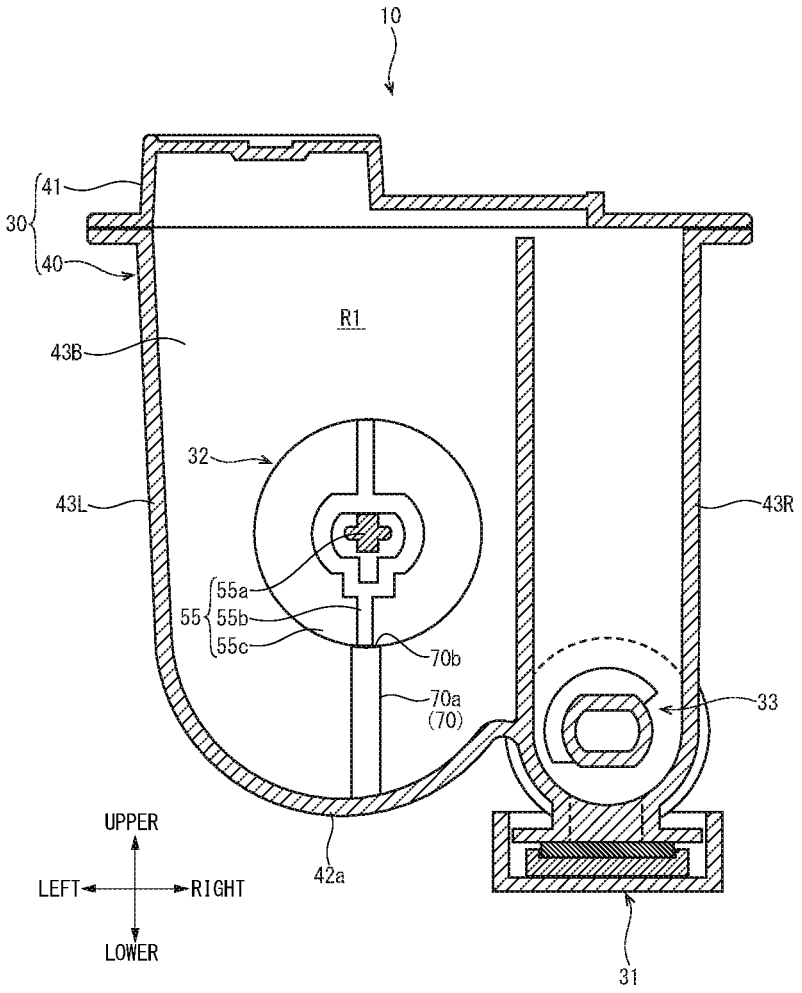
FIG. 9 is a sectional view showing a toner container according to a first modification of the embodiment of the present invention.
Figure 10:
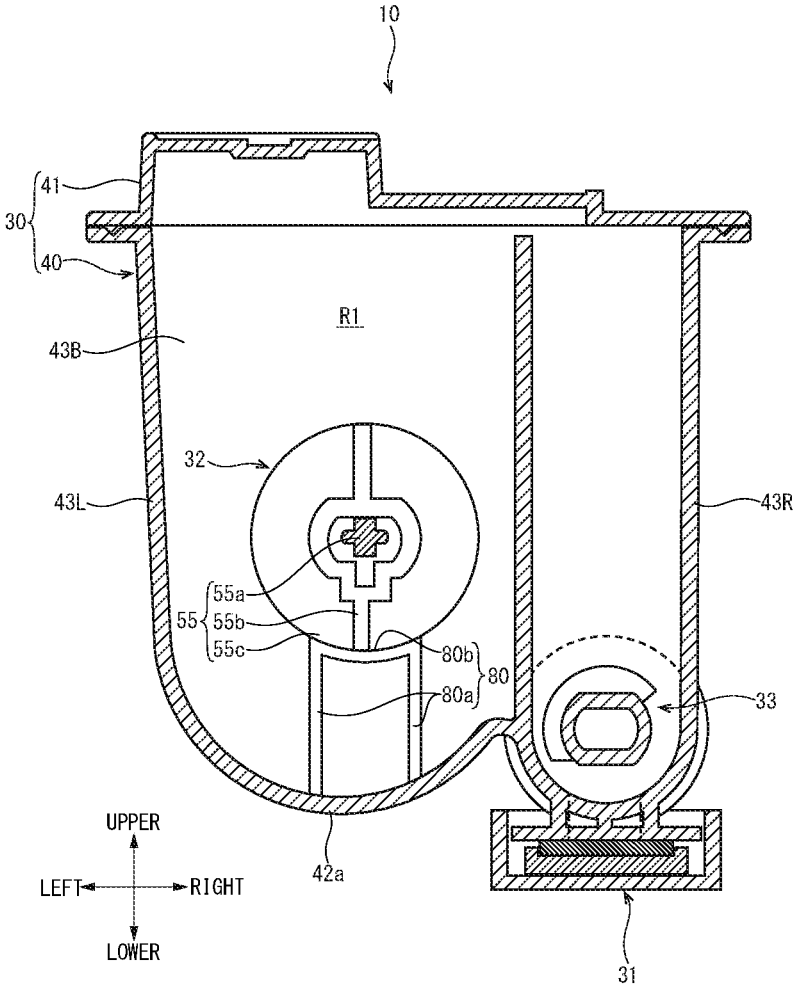
FIG. 10 is a sectional view showing a toner container according to a second modification of the embodiment of the present invention.
Figure 11:
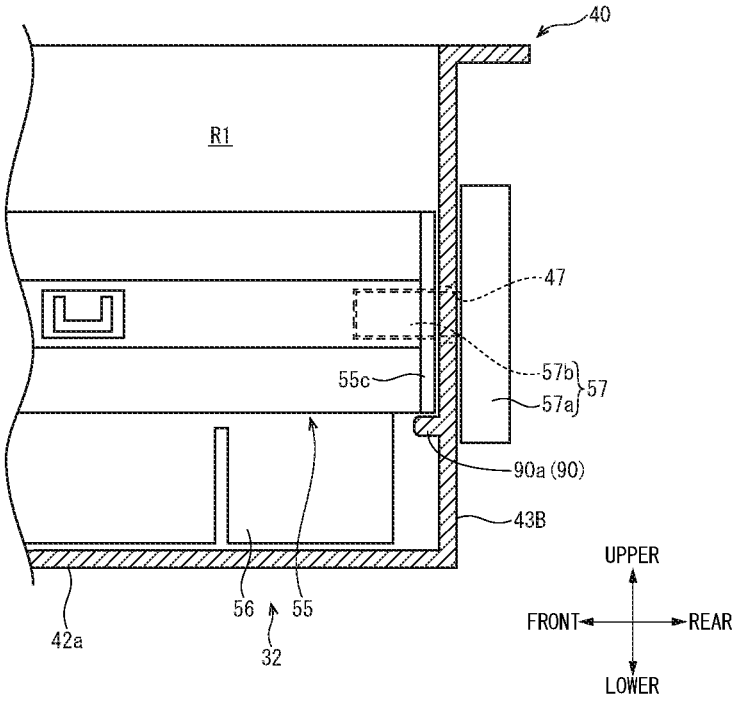
FIG. 11 is a sectional view showing a toner container according to a third modification of the embodiment of the present invention.

In this regard, the toner container 10 according to the present embodiment includes the holder 49 formed by the pair of left and right ribs 49*a*. However, the present invention is not limited to this. The plurality of (two or more) ribs 49*a* are preferably formed so as to be separated from each other in the width direction vertical to the axis direction of the agitator 32. In addition, as shown in FIG. 9, a holder 70 may include only one rib 70*a* which extends in the upper and lower direction (first modification). In this case, a curved recess 70*b* curved so as to project downward is formed on an upper end face of the rib 70*a* to meet a curve of a lower side surface of the flange 55*c*, and this curved recess 70*b* preferably holds the flange 55*c* of the disk shape. Additionally, as shown in FIG. 10, a holder 80 may include a pair of left and right ribs 80*a* which extend in the upper and lower direction and a bridge 80*b* which is arranged between upper ends of the pair of left and right ribs 80*a*, and this bridge 80*b* may hold the flange 55*c* of the disk shape (second modification). The bridge 80*b* may be formed substantially horizontally. However, the bridge 80*b* is preferably curved so as to project downward to meet a curve of the lower side surface of the flange 55*c*. Further, although not shown, each rib 80*a* may be omitted, and only the bridge 80*b* may function as the holder 80. Additionally, as shown in FIG. 11, a holder 90 may be one or more protrusions 90*a* protruding from the sidewall 43B (third modification). In this regard, the bridge 80*b* and the protrusions 90*a* are preferably molded by using a slide core metallic mold. Further, a metallic mold which slides toward an outside of the sidewall 43B may be used to make the thickness of the sidewall 43B uniform.

In this regard, the holders 49, 70, 80 and 90 (referred to as the "holders 49 and the like" below) of the toner container 10 according to the present embodiment are formed on the rear sidewall 43B. However, the present invention is not limited to this. The holders 49 and the like may be formed on at least one of the pair of front and rear sidewalls 43F and 43B. For example, the holders 49 and the like may be formed on the front sidewall 43F instead of the sidewall 43B. In this case, the agitating bearing boss 45 is formed in the sidewall 43B, and the agitating support hole 47 is formed in the sidewall 43F. Further, the agitating coupling 57 is fixed to the front end of the agitating rotation shaft 55 so as to sandwich the sidewall 43F. Furthermore, the holders 49 and the like of the toner container 10 according to the present embodiment hold the flange 55C of the agitating rotation shaft 55. However, the flange 55*c* may be omitted, and the holders 49 and the like may hold an end part of the corner axis 55*a*. Still further, a holder (not shown) which holds an end part in the longitudinal direction of the conveying rotation shaft 60 may be arranged.

In addition, the above-mentioned embodiment describes one aspect of the developer case according to the present invention and the image forming apparatus which includes the developer case. The technical scope of the present invention is not limited to the above embodiment. The components in the above-mentioned embodiment can be optionally replaced or combined with existing components, and the description of the above-mentioned embodiment does not limit the contents of the invention recited in the claims.

The invention claimed is:

1. A developer case comprising:

a case main body containing developer;

a rotator rotatably arranged between a pair of sidewalls of the case main body, the pair of sidewalls being opposed to each other;

a coupling coupled to the rotator with at least one of the pair of sidewalls in between; and a holder protruding on an inner face of at least the one of the pair of sidewalls and holding an end in an axis direction of the rotator at a position where the end is capable of coupling to the coupling, wherein the rotator includes a flange extending to a radial direction at the end in the axis direction of the rotator, and the holder holds the flange, wherein the holder includes:

a pair of left and right ribs extending in upper and lower direction; and a bridge arranged between upper ends of the pair of left and right ribs and curved so as to project downward, and the flange is formed in a disk shape and held by the bridge.

2. The developer case according to claim 1, wherein the case main body includes:

a storing case including the sidewalls erected around a bottom of the storing case, the storing case having an opened upper face; and a lid sealing the upper face of the storing case, and the storing case and the holder are integrally formed by using a metallic mold, and the holder includes the pair of left and right ribs extending along a releasing direction in which the metallic mold is released upward.

3. The developer case according to claim 2, wherein the pair of left and right ribs are formed so as to be separated from each other in a width direction vertical to the axis direction of the rotator.

4. The developer case according to claim 1, wherein the rotator is included in an agitator which agitates the developer contained in the case main body.

5. An image forming apparatus comprising the developer case according to claim 1.

* * * * *